United States Patent [19]

Bachmann et al.

[11] Patent Number: 4,637,961

[45] **Date of Patent: * Jan. 20, 1987**

[54] SHELL FOR CAN ENDS

[75] Inventors: Henry C. Bachmann; Omar L. Brown; Ermal C. Fraze; David K. Wynn, all of Dayton; James R. Gregg, Springboro, all of Ohio

[73] Assignee: Dayton Reliable Tool & Mfg. Co., Dayton, Ohio

[ * ] Notice: The portion of the term of this patent subsequent to Dec. 31, 2002 has been disclaimed.

[21] Appl. No.: 768,162

[22] Filed: Aug. 22, 1985

Related U.S. Application Data

[63] Continuation of Ser. No. 571,243, Jan. 16, 1984, abandoned.

[51] Int. Cl.[4] ..... B21D 53/00

[52] U.S. Cl. ..... 428/579; 72/379; 72/701; 222/66; 413/56; 428/582

[58] Field of Search ..... 72/347, 348, 379, 701; 220/67, 62, 66; 428/579, 582, 578, 577; 413/56

[56] References Cited

U.S. PATENT DOCUMENTS

| | | | |
|---|---|---|---|
| 3,952,677 | 4/1976 | Hartman et al. | 220/66 |
| 3,957,005 | 5/1976 | Heffner | 72/348 |
| 4,005,665 | 2/1977 | Nishihara et al. | 72/379 |
| 4,157,693 | 6/1979 | Openchowski et al. . | |
| 4,215,795 | 8/1980 | Elser | 220/67 |
| 4,382,737 | 5/1983 | Jensen et al. | 72/348 |
| 4,448,322 | 5/1984 | Kraska | 220/67 |

*Primary Examiner*—John E. Kittle
*Attorney, Agent, or Firm*—Biebel, French & Nauman

[57] ABSTRACT

The disclosure relates to a novel shell such as used in the manufacture of can ends, and to a method and tools for making such a shell. A non-circular blank having rounded corners is cut from thin metal. The blank is oblong in a direction transverse to the grain of the metal. A first set of tools separates the blanks and forms a substantially flat central panel and an upward-extending chuck wall about the edge of the panel to produce a partially formed shell. The junction area between said panel and said chuck wall has a relatively large radius of curvature at this time. A second set of tools forms in the blank a lip extending outward from the upper end of the chuck wall and generally parallel to said panel; then the panel and the chuck wall are separately gripped, followed by relative movement between the panel and the chuck wall while wrapping the junction area around a forming punch to form a panel wall in said junction area extending upward from the inner part of said chuck wall. Then the lip is formed into a curl edge section which ends in an inner curl diameter that is round and concentric with the chuck wall, and has progressively lesser radii of curvature from upper end of the chuck wall to the inner curl diameter. The resulting shell is characterized by a curl diameter being round and concentric with the chuck wall and essentially uniformly spaced therefrom, and by having an essentially constant thickness throughout the central panel, the panel wall and chuck wall and the curved section therebetween.

10 Claims, 12 Drawing Figures

SHELL FOR CAN ENDS

This application is a continuation of Ser. No. 571,243, filed Jan. 16, 1984, which is now abandoned.

BACKGROUND OF THE INVENTION

This invention relates to metal shells used to form ends of can type containers. Most can type containers, for example beer cans and soft drink cans, are required to withstand internal pressure, rough handling, and substantial temperature differences, yet maintain a complete hermetic seal to protect the contents of the can. Cans of this type are used in very large volumes, billions of cans per year, and at present the metal most used for this purpose is aluminum due to its light weight, comparative inexpensiveness and workability.

The typical modern can consists of a unitary deep drawn body, usually with a necked inward throat at the top which terminates in an outwardly extending body curl, and an end for the can which comprises the shell (to which the present invention pertains) provided with self-opening structure such as tear tabs and related score lines in the shell. The shells are manufactured from sheet metal by severing a suitable blank from a strip thereof, forming the blank to define a central panel surrounded by a reinforcing countersink and chuck wall configuration, and a shell curl which is designed to interact with the body curl in seaming apparatus to attach the end to the can with the requisite hermetic seal. In most instances the underside of the shell or end curl is provided with a sealing compound to assist in the formation of the seal.

The shell is the basic part of the end and is formed from the blanks, then the shells are operated upon in converting apparatus which adds the desired score lines, tear tab, and the integral rivet attachment between the shell and the tab, all in known manner. The sealing compound may be applied to the underside of the shell, specifically to the downward facing or bottom portion of the shell curl, either before the converting operation, or after, the former being more typical.

One of the major endeavors of designers of can ends is to provide a shell of as thin material as is possible, since this can result in substantial savings of material, and therefore expense. However the integrity of the shell, and its ability to withstand buckling from internal pressures in particular, imposes restrictions upon the use of very thin material in the shell formation. The ability of the thin metal to withstand the drawing and working imposed upon the blank during the formation of the shell generally calls for use of somewhat thicker metal, in order to accommodate thinning in the region where the reinforcing structure is formed in the shell.

In typical prior art operations for the forming of shells, a blank is severed from sheet material, usually steel or aluminum, and it is then formed to a shape comprising a generally flat central panel and a chuck wall extending, in this initial stage, upwardly and outwardly from the central panel, blending into a curved flanged portion. In one prior art method the blank is formed to include a groove around the central panel inward from the chuck wall. This initial blank is then subjected to a curling operation to form a curled edge on the flange, the curled edge being turned somewhat under the flanged portion.

From the curling operation, the partially formed shells are fed through further tooling where they are gripped in the flange portion, while the curled edge is protected in the tooling against deformation. If the groove is already in the blank, then the groove may be reformed. If not, the thus clamped blank is moved against a stationary support applied against the major underside of the central panel.

There is an unsupported region in the shell comprising the edge of the central panel which overlaps and extends beyond the stationary support, out to the region where part of the chuck wall is clamped. This collapsing action places the blank in compression, and results in a reshaping of the unsupported band of material between the chuck wall and the central panel, into a shape which defines a reinforcing channel or countersink at the bottom of the chuck wall and into the periphery of the central panel. Thus, the formation of the end shells according to the prior art requires a three stage operation, and the above described formation of a reinforcing channel shape into the shell results from a working of a band of the metal blank between the chuck wall and the central panel which is essentially uncontrolled and thus susceptible to breaks, distortion, or potential thinning of the shell at this critical point in its structure.

In addition, prior art shells are subject to a condition in the region of the peripheral flange and curled edge which is known in the art as "earring". When the blank of metal is severed from the supply strip, usually a strip withdrawn from a roll thereof, prior practice is to cut or sever a round blank, and little attention is given to the grain direction of the metal, which runs lengthwise of the strip. It has been known for some time, but apparently uncorrected, that forming of the metal (particularly thin aluminum) in operations which are intended to produce a round shell, results in some distortion of the shape from the initial round blank, because the metal tends to stretch slightly more with the grain than across the grain, and to stretch even further at 45° to the grain. The result of such uneven "growth" of the metal appears as a slight deformation in the edge of the blank which is subjected to the curling operation. The curled under edge thus is somewhat closer to the chuck wall in certain areas than in others around the shell; i.e. the end curl becomes irregular with respect to the chuck wall.

This situation can result in one of two difficulties. If the shell is manufactured such that the enlarged "earrings" on the periphery form the primary seal in the seam of the end to the can, then the end curl of the blank between the "earrings" is short, and must rely more upon the sealing compound to maintain the hermetic seal since the metal of the end curl may not tuck completely under the curl on the can body in those regions. In terms of describing the completed seam, it can be said that the end or cover hook does not extend completely behind the body hook throughout the seam.

Alternatively, to achieve a hermetic seal between the end and the body, the design may accommodate for the enlargement of the "earrings", such that the edge between such earrings is completely tucked under the body curl during seaming. This, however, leaves an excess of metal in the cover or end hook extending into the seam in the region where the earrings exist, and this can lead to puncturing of the thin can body in the region of the neck, or to wrinkling of the excessive material within the curled seam, thereby destroying the uniformity of the seam. Whatever the result, the tendency is to have an unacceptably great percentage of cans which leak after they have been filled and sealed. This of course is unacceptable from the standpoint that the packaged product is lost, and additional damage from spillage, etc. may also result.

SUMMARY OF THE INVENTION

The present invention, therefore, provides a method and apparatus whereby the aforementioned earring problem is essentially overcome, and furthermore in which a shell is provided having more uniform thickness throughout its extent, including the requisite chuck wall and the re-enforcing panel wall connecting between the chuck wall and the central panel of the shell. In addition, the invention provides a shell having an improved partial curl at its periphery in which the inward edge of the curl is pre-formed such that during the seaming operations, when the end formed from the shell is attached to a can, the curl will roll smoothly into the curled seam, minimizing the possibility of wrinkled seams and/or punctures or cuts of the can neck in the region of the seam.

The earring is minimized, and the inner curl diameter spacing from the chuck wall of the shell is made more uniform and concentric, by forming the shell from a blank which is multi-sided in configuration rather than circular. The shape of the blank is such that the diameter of the blank parallel to the grain of the strip from which it is formed is less than the diameter of the blank transverse to the grain direction. The diameters with and transverse to the grain and at 45° to the grain direction are different and the transition of the side edges of the blank are rounded. This initial formation of the blank, together with controlled forming and drawing operations on the blank to form the shell, results in a final shell product having the desired concentricity and uniform spacing of curl diameter with respect to the chuck wall, having more constant thickness, thus resulting in a better and more uniform seam in the ultimate finished can and thereby minimizing the number of failures encountered.

The invention also provides a finished shell, and a process of manufacturing such a shell, in which the shell is formed in two steps solely by reciprocable tooling in one or more presses, for example a standard single action press. No additional curling or the like is necessary to finish the desired pre-formed curl at the periphery of the shell.

The object of the invention, therefore, is to provide a unique shell for making can ends which is characterized by minimized earring, more uniform concentricity of the inner and outer curl with the chuck wall, more uniform thickness especially through the connection between the chuck wall and the central panel, and an improved pre-formed curl around the periphery of the shell; to provide tooling for a reciprocating press, preferably of the single-acting type, which can manufacture such shells rapidly in large quantities; to provide an improved method for making such shells including the use of a specially designed multi-sided blank to accommodate for the different response of the blank material to the tooling acting along or across the grain, and also including controlled formation of the junction area between the chuck wall and the central panel of the shell whereby a more uniform thickness of the shell material is maintained.

Other objects and advantages of the invention will be apparent from the following description, the accompanying drawings and the appended claims.

DESCRIPTION OF THE PREFERRED EMBODIMENT

The making of a shell according to the invention is generally divided into two operations, each of which can be carried out within a conventional single-action ram press having a specially adapted tooling. A typical press utilized is a Minster P2-45, although many other models are also suitable for use.

Initially, the relatively thin metal stock S (FIG. 3) from which the shell is ultimately formed is fed to one or more stations within the press. The press ram operates at each of these first stations to separate a blank B from the stock, and to partially form the shell from the blank.

The partially completed shell formed at each of the first stations is then transferred to a corresponding second station within the same press, where the forming of the shells is completed, the press is opened, and the completed shells are discharged from the press.

In a preferred form of the invention, for each stroke of a single press, a partially formed shell is finished by each second tooling station while a blank is produced and partially formed by each first station tooling. Moreover, the transfer of shells between stations is accomplished so that a shell partially formed in a first station by one press stroke is completed at the second station by the next succeeding stroke. It should be understood, however, that the first and second stations and corresponding tooling can readily be located in different presses, and the partially formed shells can be transferred immmediately from one press to the other (second), or the partially formed shells can be collected from the first press and later processed in second station tooling by the second press.

Blank Configuration

Figure 1:
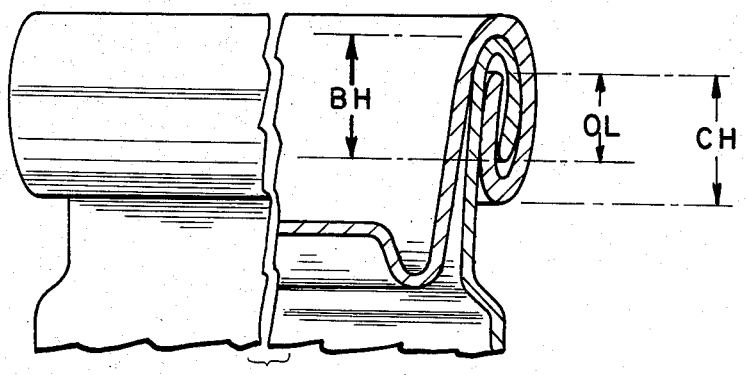
FIG. 1 is a view of the top of a typical beverage can, with a portion broken away and shown in cross-section to illustrate the seam between the can body and the end.
Figure 3:
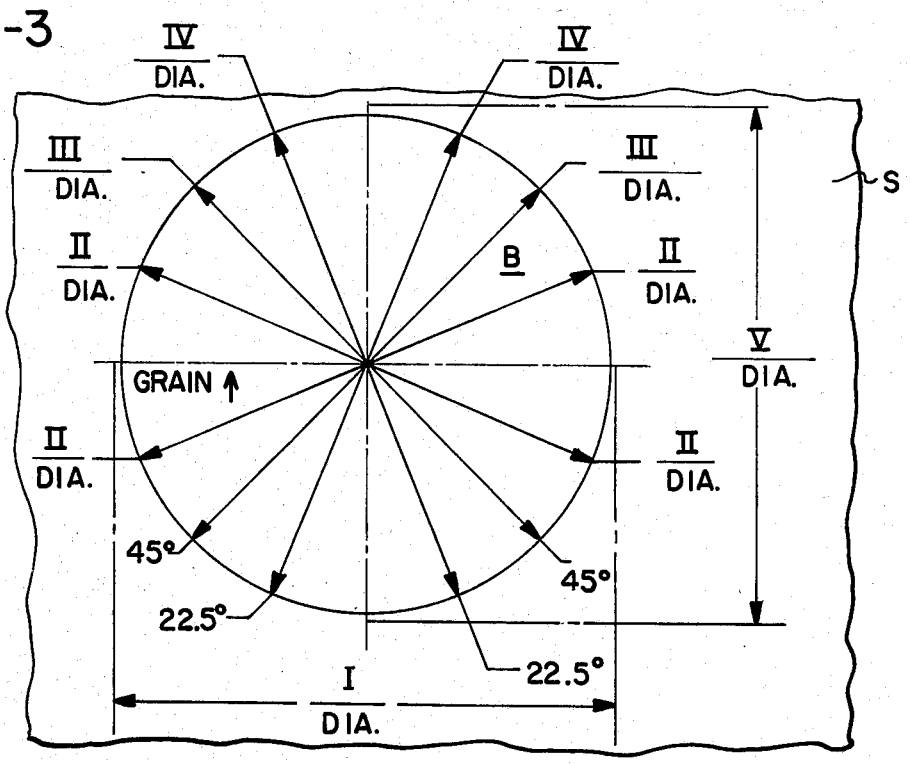
FIG. 3 illustrates a fragment of a strip of sheet metal material, illustrating the configuration of blanks to be severed from such material for the formation of shells, in accordance with the invention.

Referring to FIGS. 1 and 3, a portion of the strip of material from which the blanks are cut is shown at S in FIG. 3, and the shape of the blank is indicated within the area designated B which, as will be described, is a multi-sided form with rounded transitions from one side to the next, rather than an accurate circle of the same diameter throughout. Referring to FIG. 1, the seam between a typical end and the body of a can is seen to include the body hook BH and the end or cover hook CH, and the region of overlap between these two is indicated by the dimension OL. A quantity of sealing compound is located in the area between the top of the body hook and the undersurface of the end, however this compound is not illustrated in FIG. 1.

The effect of earring is either to cause a very small amount of overlap, or to cause excessive overlap in which case the end of the end or cover hook interferes with the bending of the seam parts at the top of the seam, or punctures the wall of the can body in this region.

It has been discovered that the earring effect or distortion can be greatly minimized if the shape of the blank B is properly selected with respect to the grain of the material, which is indicated by an arrow and appropriate legend in FIG. 3. Thin sheet metal material, for example aluminum and steel, tends to "grow" or stretch more in the direction of the grain and in a direction at 45° to the grain, rather than across the grain. The dimensions stated are exemplary only, but serve to illustrate the principles applied in designing the shape of the blank in accordance with the invention. The diameter of the blank B along its horizontal axis I—I diameter, as shown in FIG. 3, is the largest, since it is in this direction that the blank least tends to grow as it is worked in forming the shell. A typical dimension along this diameter, for a typical size blank to form one standard size of an end is 2.987 inches. The vertical diameter V—V of the blank, on the other hand, is typically 2.980 inches. The diameter III—III of the blank at 45° in each direction from the vertical diameter is 2.974 inches; the diameter IV—IV of the blank at 22.5° in each direction from the diameter V—V is 2.982 inches; and the diameter II—II at 22.5° in each direction from horizontal is 2.984 inches. A blank of this configuration, when produced in accordance with the invention from 0.0114 aluminum, results in a shell which has an inner curl diameter ICD (FIG. 2) that is round within 0.003 to 0.005 inch, and that is concentric to the chuck wall of the shell (as later described) within 0.003 to 0.005 total indicator reading, and is essentially absent any earring. It should be understood that the foregoing dimensions are specifically applicable to a certain size shell made from a certain metal, and are intended to be exemplary of the invention, its principals, and its application. This information is not restrictive as to the scope of the invention.

Figure 2:
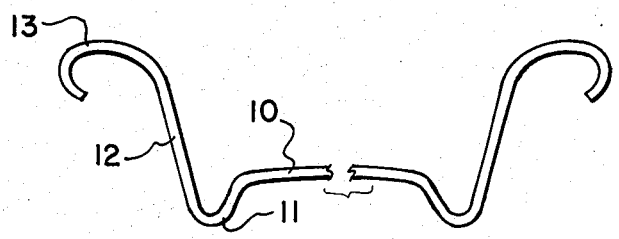
FIG. 2 is a broken and shortened cross-sectional view of a shell for a can end, as provided by this invention.

Referring to FIG. 2, there is shown in cross-section, substantially enlarged beyond the normal size of an actual shell, the configuration of a finished shell as provided by the invention. The shell is, of course, an integral metal part, made from a suitable metal blank, shaped as previously described, and in its final configuration including a flat central panel 10, a countersunk reinforcing area 11 extending into a relatively straight upward and outward shaped chuck wall 12, and a lip or curl edge portion 13 which terminates at the inner curl diameter.

First Station Tooling and Operation

The press tooling for each of the first stations is shown in FIGS. 4–7. The upper tooling is connected for operation by the press ram, while the lower tooling is fixed to the press frame.

The lower tooling includes die cut edge 14, over which the metal stock S as it enters the tooling at a level generally indicated by line 16. Die cut edge 14, along with die form ring 18 are solidly supported on a suitable base member. Additionally, the lower tooling includes draw ring 24, positioned between die form ring 18 and die cut edge 14. A center pressure pad 25 is located concentrically within form ring 18. Draw ring 24 is supported by springs (not shown), mounted in the base member, which, compress due to pressure exerted upon draw ring 24 when the tooling is closed. The center pressure pad 25 is also supported by a spring (not shown) which will compress in response to force exerted by the upper tooling.

When the tooling is open, draw ring 24 and center pressure pad 25 are retained in the lower tooling with draw ring 24 bottoming against die cut edge 14 and center pressure pad 25 against form ring 18. The uppermost surface of draw ring 24 is then at a position some distance below the lowest point of shear on the die cut edge 14, while the uppermost surface of the center pressure pad 25 is some distance above draw ring 24 and below the lowest point of shear on die cut edge 14.

The upper tooling is provided with blank punch 30 positioned to cooperate with draw ring 24 for as the tooling is closed. A knockout and positioner 32 is located above die form ring 18, and punch center 34 is provided with an appropriate configuration to produce the partially completed shell, as well as to clamp a blank in cooperation with center pressure pad 25. Blank punch 30, knockout and positioner 32, and punch center 34 are all closed simultaneously upon the lower tooling as the press ram is lowered.

Figure 4:
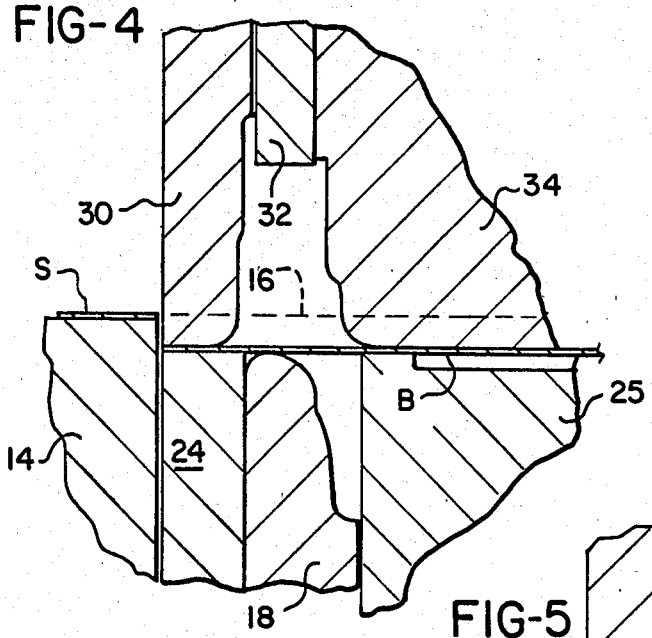
FIGS. 4, 5, 6 and 7 are enlarged (about two and one-half times) partial cross-sectional views of tooling used in accordance with the invention at a first operating station to form a partially completed shell, the peripheral configuration of which is shown in FIG. 7.
Figure 5:
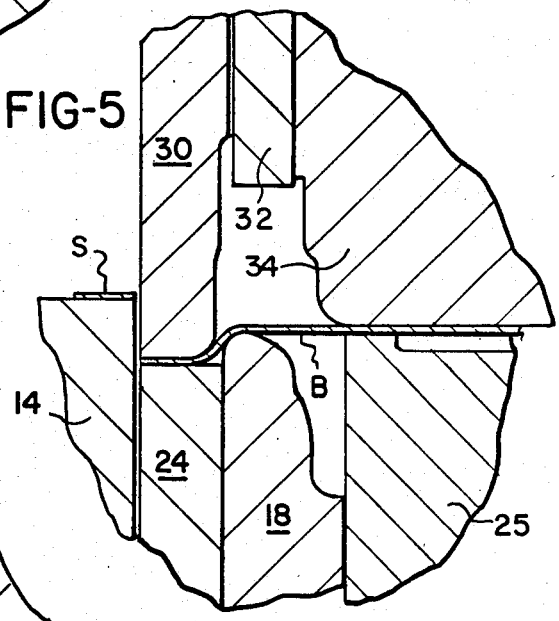

The sequential operation of the first station tooling to produce the blank from the stock and partially form a shell is shown in FIGS. 4–7. In FIG. 4, the tooling is shown already partially closed. The stock S enters the tooling along a line indicated at 16, and as the press ram is lowered, a flat blank B is produced by shearing the stock material between die cut edge 14 and blank punch 30.

Since the blank punch 30 and punch center 34 move simultaneously, the lowermost surface of blank punch 30 must lead the lowermost surface of punch center 34 by some distance so punch center 34 does not interfere with the stock S during blanking.

Further, the distance by which blank punch 30 leads punch center 34 is less than the distance at which the uppermost surface of center pressure pad 25 is above the uppermost surface of draw ring 24 in lower tooling 12. This causes the entire central panel of blank B to be clamped between punch center 34 and center pressure pad 25 first, followed by pinching of the outermost part of blank B between blank punch 30 and draw ring 24 before any forming begins. Use of the central clamping secures the blank B in a centered position within the tooling during subsequent forming of a shell from the blank. Holding the blank in a centered position contributes to controlled working of the blank and minimizing variation in the curled lip portion provided at the outer edge of the completed shell, providing a more even amount of material for later seaming.

As the press ram continues downward, the blank punch 30, support ring 32, and punch center 34 all continue to move simultaneously. At the point illustrated in FIG. 5, the blank is still pinched between blank punch 30 and draw ring 24 and between punch center 34 and pad 25, beginning the formation of the shell over die form ring 18. It will be noted that as the blank B is formed over form ring 18, it is pulled from between blank punch 30 and draw ring 24.

Figure 6:
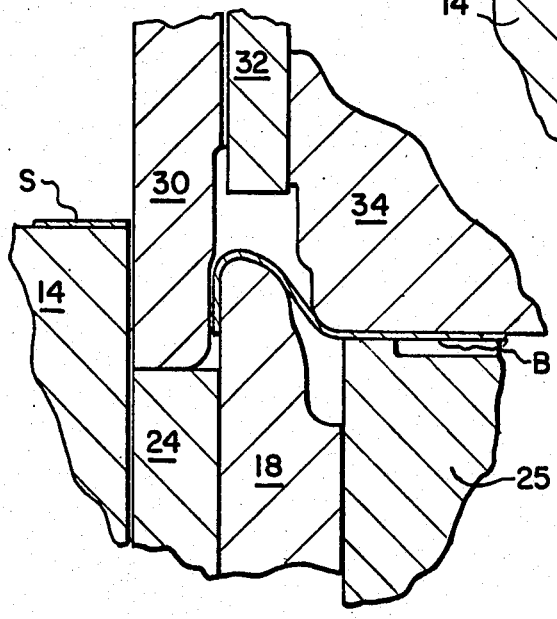

Referring to FIG. 6, the press ram continues to move downward as the punch center 34 begins to form the chuck wall 12 on blank B. The blank material is no longer held between the blank punch 30 and the draw ring 24, but is still held between punch center 34 and pad 25, and the draw ring 24 no longer controls the formation of the shell. The clearance between the inside diameter of the blank punch 30 and the outside diameter of the die form ring 18 is selected to provide an appropriate amount of drag or resistance on the blank B to insure proper formation. The inside diameter of blank punch 30 slightly narrows above the curves shown at 49 (shown exaggerated for clarity). Thus, near the end of the press stroke, as can be seen by comparing FIGS. 4 and 5, the drag on the outermost portion of blank B is increased. This is to insure that this portion of the resulting shell 48 is drawn more tightly over die form ring 18 so that the curl found in shell 48 extends to the very edge of shell 48, without any straight or less than fully curled portions.

Figure 7:
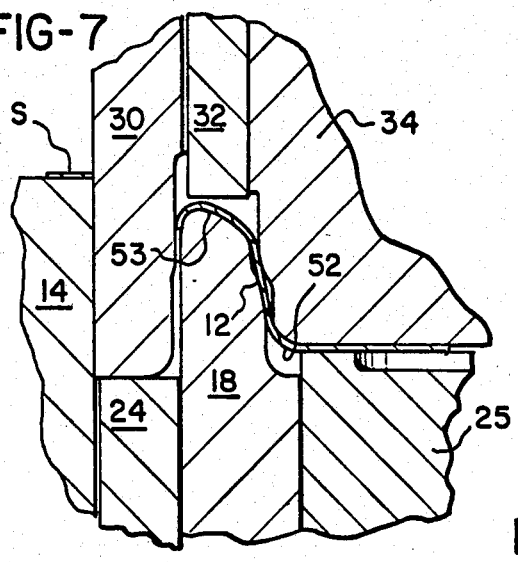

In FIG. 7, the tooling is shown in its closed position with the press ram bottomed against appropriate stop blocks. The first portion of the shell formation operation is completed, with the flat central panel 10 terminating at a relatively large radius area 52 to produce a soft stretch so as not to overwork the material in this area. The large radius area 52 forms the junction region of chuck wall 12 with the central panel 10, and will later form the shell countersink and panel form radius. A sufficiently large radius is provided that a much tighter radius can later be provided for the shell countersink while maintaining sufficient material thickness. It can be seen from FIG. 7 that the reverse bends applied to the inner wall of die center form ring 18 and the outer wall of punch center 34 serve to produce a straight chuck wall 12 without either inward or outward bowing, enabling the shell to fit accurately within the second station tooling.

The shell is further provided with a lip 53 extending generally outwardly and upwardly from the chuck wall 51, but having general downward curvature. Lip 53 is provided with two distinct curvatures, giving lip 53 a "gull-wing" cross-sectional configuration. Its portion adjacent chuckwall 12 has only slight relative curvature and thus provides the upward extension of lip 53, while the outermost portion is provided with a relatively sharp downward curvature by dieform ring 18. However the outer edge of lip 53 is located to at least even with, if not above, the point where lip 53 connects with the shell chuck wall 12.

Upon closure of the tooling, knockout and positioner 32 does not contact the partly completed shell. Once the forming operation has been completed, the press ram is raised to open the tooling, and the shell pre-form is held within blank punch 30 by the tight fit of its lip 53 therein, and is carried upward by the upper tooling. Once the lowermost portion of the shell pre-form has cleared the stock level indicated in FIG. 3 at 16, knockout and positioner 32 halts its upward movement while blank punch 30 and punch center 34 continue to rise with the press ram. When upward movement of knockout and positioner 32 is stopped the shell pre-form will contact it, and this pushes the shell pre-form from within the still-moving blank punch 30.

The partly formed shell 48 is then held in position on knockout and positioner 32 through application of a vacuum, via appropriate passageways (not shown) through the upper tooling to the surface of punch center 34. This vacuum then causes the shell pre-form to adhere to the surface of knockout and positioner 32 until it is removed.

Upon completion of the first operation upon the shell, it is moved by a transfer system, such as described in copending U.S. patent application Ser. No. 571,051 filed concurrently herewith and assigned to the same assignee, to a corresponding one of a plurality of second stations for completion of the formation process.

Second Station Tooling and Operation

The tooling for the second station is shown in FIGS. 8–11, including upper tooling 61 supported on the press ram and lower tooling 62 supported on the press bed. The lower tooling 62 includes a curl die 64 and panel form punch 66, both fixed in turn to suitable base members. An insert 71 is mounted within panel form punch 66. A spring pressure pad 72 is concentrically mounted between curl die 64 and panel form punch 66, supported by a plurality of springs 74 (not shown) mounted within the base which supports the lower tooling. A fitting 75, for connection of a source of vacumn, leads into vacumn passageways 76, 78 provided to supply vacuum to the upper surface of panel form punch 66.

The upper 61 tooling includes a curl form punch and positioner 84 having a projection 85 for defining the forming characteristics of the lower surface of form punch and positioner 84. Additionally, panel form die 86 is mounted generally for movement along with the form punch and positioner 84. Panel form die 86 is supported from the press ram through a plurality of springs 90 (not shown), which are selected to provide a "dwell" in the downward movement of panel form die 86 as the press ram is lowered.

Vacuum passageways 92, 93 are provided through panel form die 86, form punch and positioner 84, and their mounting respectively, thus vacuum may be supplied to the lower face of panel form die 86.

Figure 9:
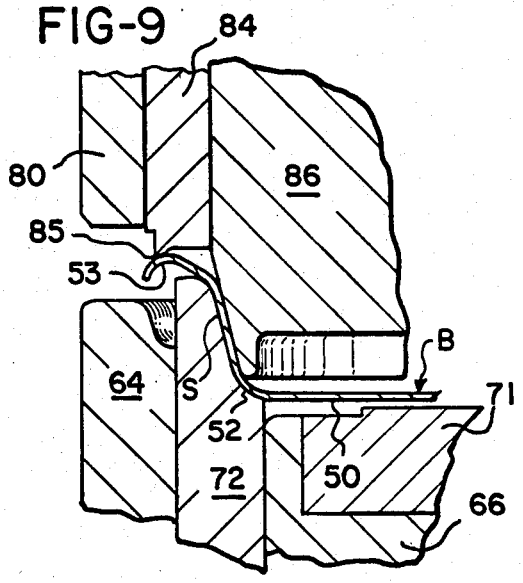
FIGS. 8, 9, 10 and 11 are similar enlarged partial cross-sectional view of the tooling and its sequential operation at a second station to complete the formation of shells in accordance with the invention.
Figure 8:
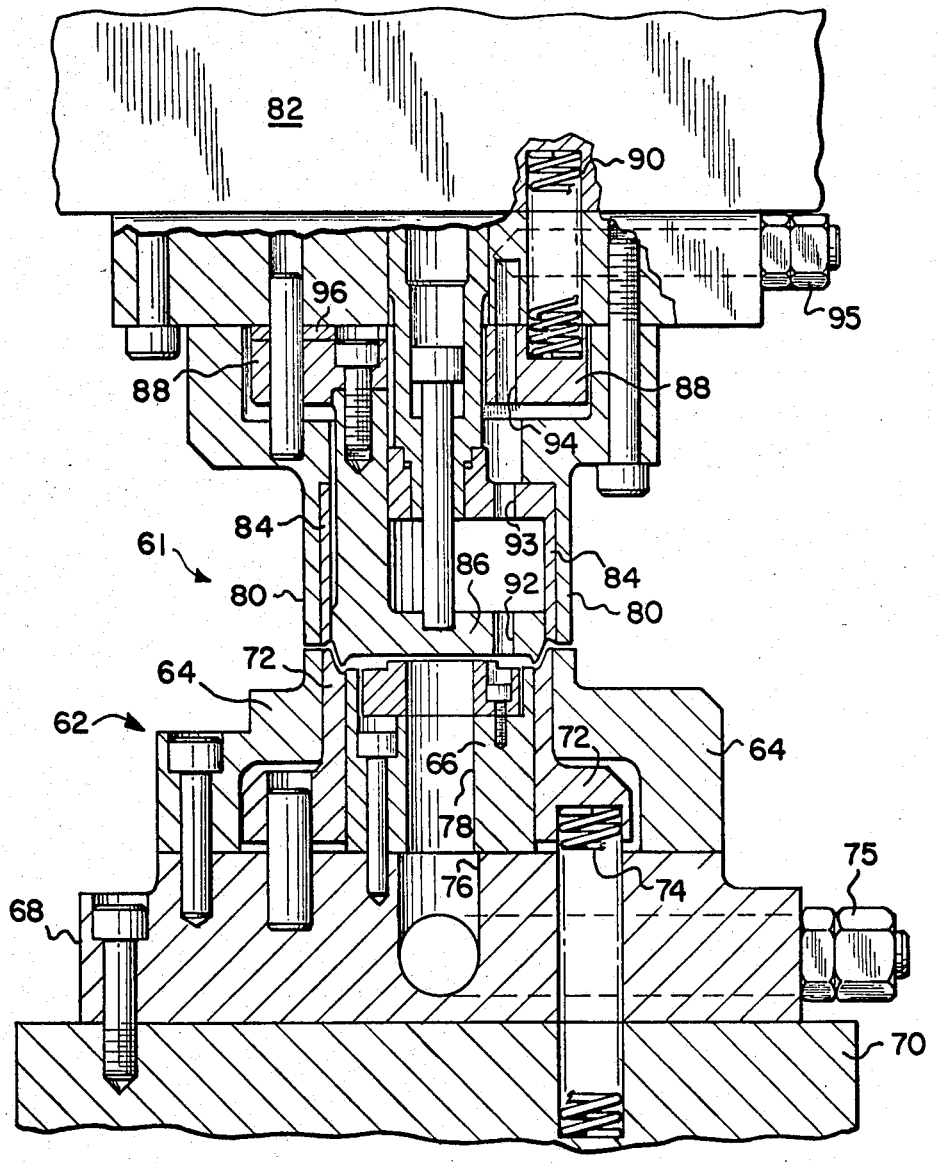
Figure 10:
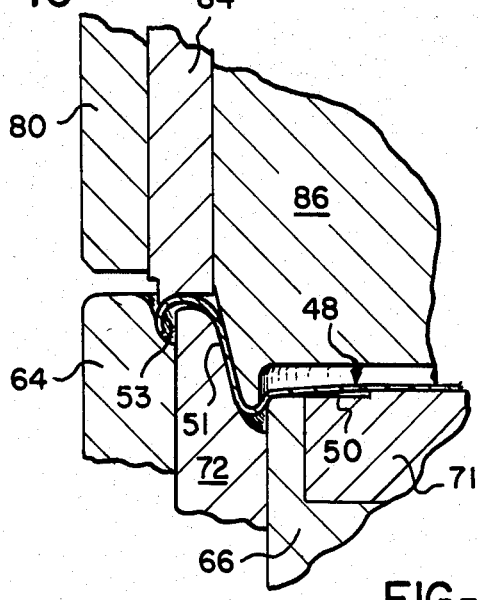
Figure 11:
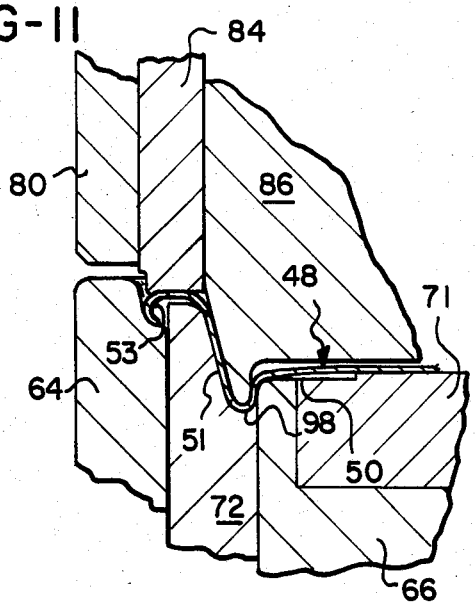

The sequential operation of the tooling of each of the second stations for completion of a shell is shown in detail in FIGS. 9–11. The shell pre-form enters the open tooling of the second station and is properly positioned on the lower tooling. The large radius area 52 and chuck wall 12 are supported by the spring pressure pad 72, with the entire central panel 10 supported some distance above insert 71. The shell pre-form is located and held in place by the vacuum supplied to the upper surface of panel form punch 66.

In FIG. 9, lowering of the press ram causes panel form die 86 to contact chuck wall 12, clamping it between panel form die 86 and spring pressure pad 72. The spring pressure on form die 86 is selected to be more easily compressible than the springs supporting the pressure pad, so that once contact with chuck wall 12 is made, panel form die 86 is held in position by spring pressure pad 72 and begins to dwell despite further lowering of the press ram. Subsequently, form punch and positioner 84 contacts lip 53.

As seen in FIGS. 9 and 10, continued downward movement of the press ram causes the form punch and positioner 84 to begin to push shell lip 53 toward its intended final configuration. The shell preform continues to be clamped between panel form die 86 and spring pressure pad 72, with panel form die 86 continuing to dwell until downward movement of the press ram causes spacer 96 to bottom against a base plate, shown in FIG. 8.

Once spacer 96 has bottomed against a base plate, then further downward movement of the tooling by the press ram causes the panel form die 86 to move downward, as shown in FIG. 10, forcing the spring pressure pad 72 to move downward as well. Insert 71 includes a raised center 91 which now is positioned against the shell pre-form panel 50. Downward movement of spring pressure pad 72 effectively causes upward movement of the panel 50 with respect to the remainder of shell pre-form, reducing the distance between the uppermost portion of the shell pre-form and the panel 50. The shell material from the large panel radius area 52 begins to pull away from the spring pressure pad 72 and wrap around the edges of the panel form punch 66 and the panel form die 86 (FIGS. 9 and 10). The wrapping action takes place under precise control with little drawing of the shell material, to produce a pressure resistant panel for the completed shell by reforming the large radius area 52 into the countersink 98. Raised center portion 91 of insert 71 causes panel 50 to be bowed slightly upward. This is to counteract a tendency of panel 50 to bow downwardly during shell forming, and thus resulting in a flat finished panel. Simultaneously, the shell lip 53 enters the curl die 64 for final shaping.

The tooling is shown in its closed position in FIG. 11. The completed shell 48, now includes a pressure resistant panel 50 surrounded by countersink 98 and a die curled lip 53 having a hook portion, i.e. an outer curl edge section of relatively lesser radius of curvature, suitable for seaming onto a can. The reasons for formation of the "gull-wing" lip 53 at the first station 10 can now be readily appreciated. By pre-curling the outer portion of lip 53 to a relatively sharp radius, extending to the edge of the shell, the natural tendency of the outermost edge to resist die curling and remain relatively straight can be overcome. Moreover, by forming the less sharply curved portion of lip 53 at the first station, so as to extend upwardly as well as outwardly from chuck wall 12, some travel distance is provided for lip 53 during die curling of the outermost portion. If lip 53 were to be formed at the first station to extend from chuck wall 12 at the final desired angle, satisfactory die curling of the outer edge cannot be accomplished.

The result of these operations is to produce a shell which is characterized by its more uniform thickness throughout its cross section, and by uniformity of the spacing between chuck wall 12 and the inner curl diameter i.e. the edge of the curled lip 53.

Figure 12:
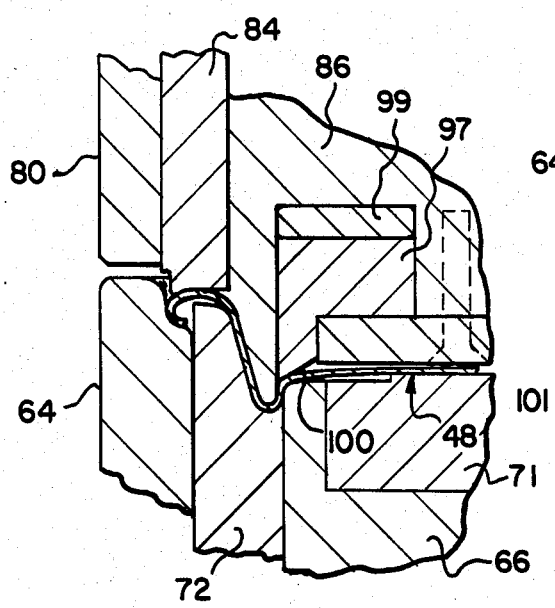
FIG. 12 is a similar view illustrating a modification of the second station tooling.

An alternative embodiment for the upper tooling 61 is shown in FIG. 12, wherein the completed shell is coined about the outer edge of panel 50 adjacent wall 98 for additional strength. While coining of shells is typically performed in a separate coining press, the embodiment of FIG. 12 enables coining to be performed as part of the forming process, eliminating the need for separate equipment and a separate process. The central portion of panel form die 86 is provided with an annular recess into which a coining ring 97 and a spacer 99 are placed. Coining ring 97 is in turn secured by retainer 101 which is attached to panel form die 86. Spacer 99 is selected so that when the tooling is fully closed as shown in FIG. 12, the working surface 100 of coining ring 97 contacts the shell 10A and provides sufficient compression to properly coin the outer edge of panel 50 of shell 10A.

As the tooling begins to open, vacuum applied to the shell 10A through passageway 92 in panel form die 86 raises the shell 10A along with upper tooling 61. Since vacuum is also applied to shell 10A through panel form punch 66, to lift the shell 10A from the lower tooling 62, it is necessary to apply a greater vacuum to the upper side of shell 10A than that applied to the lower side. In addition, upward movement of pressure pad 72 by springs 74 aids in initial stripping of shell 10A from lower tooling 62. Once shell panel 50 is away from the working surfaces of panel form punch 66 and insert 71, venting of the lower vacuum occuring through additional openings (not shown) in such working surfaces. This reduces the amount of vacuum required on upper tooling 61 to lift the completed shell 48 from lower tooling 62.

After the upper tooling 61 has lifted the shell 10A sufficiently to clear lower tooling 62, upward movement of form punch and positioner 84 is halted while upward movement of retainer 80 and panel form die 86 continues. Once these portions clear shell 48 it is removed from the second station tooling and ejected from the shell forming apparatus.

While the method and product herein described, and the form of apparatus for carrying this method into effect, constitute preferred embodiments of this invention, it is to be understood that the invention is not limited to this precise method, product and form of apparatus, and that changes may be made in either without departing from the scope of the invention, which is defined in the appended claims.

What is claimed is:

1. A method of forming shells for use in the manufacture of can ends, comprising the steps of:

forming a rounded non-circular blank from a sheet of thin metal, said blank having a greater width across the grain of the metal than along such grain;

then forming into said blank a substantially flat central panel and an upward-extending chuck wall about the edge of said panel to produce a partially formed shell, the junction area between said panel and said chuck wall defining a relatively large radius of curvature;

forming into said blank a lip extending outward from the upper end of said chuck wall and generally parallel to said panel;

separately gripping the entire panel and said chuck wall and causing relative movement between said panel and said chuck wall and simultaneously wrapping said junction area round a forming punch to form a panel wall in said junction area extending upward from the inner part of said chuck wall.

2. The method of claim 1, including the additional step of forming the lip into a curl edge section having inner and outer portions, the outer curl edge section having a lesser radius of curvature than the inner curl edge section.

3. The method of claim 2, wherein the additional step of forming the curl edge section is performed at least in part during forming of the panel wall.

4. The method of claim 1, wherein the separating and forming steps occur at a first station and the gripping and wrapping steps occur at a second station.

5. The method of claim 1, wherein the forming of said blank at the first station is performed by a first set of reciprocably relatively moving upper and lower tooling set in a press.

6. The method of claim 3, wherein the gripping and wrapping steps are performed by a second set of reciprocably relatively moving upper and lower tooling so as to complete forming of said shell therebetween.

7. The method of claim 6, wherein the first and said second tooling sets operate simultaneously upon successively separated blanks.

8. A method of forming shells for use in the manufacture of can ends, comprising the steps of:

forming a non-circular blank having rounded corners from a sheet of thin metal, said blank being oblong in a direction transverse to the grain of the metal to compensate for greater elongation of the blank along the grain during forming;

forming in said blank a substantially flat central panel and an upward-extending chuck wall about the edge of said panel to produce a partially formed shell, the junction area between said panel and said chuck wall defining a relatively large radius of curvature;

forming into said blank a lip extending outward from the upper end of said chuck wall and generally parallel to said panel;

separately gripping the entire panel and said chuck wall and causing relative movement between said panel and said chuck wall while wrapping said junction area around a forming punch to form a panel wall in said junction area extending upward from the inner part of said chuck wall; and forming the lip into a curl edge section which ends in an inner curl diameter which is round and concentric with the chuck wall, said curl edge section having progressively lesser radii of curvation from upper end of the chuck wall to the inner curl diameter.

9. Apparatus for forming shells for can ends solely by reciprocating tool operations, comprising a first set of tooling including a blank punch and die and draw ring constructed and arranged to separate a rounded non-circular blank from the strip, a form ring and punch center cooperating to form an upwardly and outwardly extending wall surrounding a central panel on the blank, said draw ring, form ring, blank punch and punch center cooperating to form a partial curl on the outer part of the blank, a second set of tooling including a panel form die and a pressure pad constructed and arranged to grip the wall of the partially formed blank inward of the partial curl and outward of the central panel and shape a chuck wall therein, said panel form die including a nose portion defining the shape of a panel wall interconnecting the chuck wall and the central panel, a panel form punch cooperating with said panel form die to wrap the region of the blank between the central panel and the gripped chuck wall around said nose portion, and a curl form punch and a curl form die constructed and arranged to complete the curl on the outer part of the shell by forming the edge of the shell extending inwardly beneath the curl at a uniform spacing from the chuck wall.

10. Apparatus for forming shells, as defined in claim 9, wherein said first and second sets of tooling are constructed and arranged for mounting adjacent each other in a reciprocating press.

* * * * *